United States Patent [19]

Sutcliffe et al.

[11] 4,331,190

[45] May 25, 1982

[54] HOOK AND SHUT-OFF BRACKET FOR AUTOMATIC FUEL NOZZLE

[75] Inventors: Grenville G. Sutcliffe, Villa Ridge; Ronald F. Bradley, St. Clair; Paul D. Mercer, Sullivan, all of Mo.

[73] Assignee: Ausley Corporation, Pacific, Mo.

[21] Appl. No.: 131,768

[22] Filed: Mar. 19, 1980

[51] Int. Cl.[3] ..... B65B 3/04

[52] U.S. Cl. ..... 141/392; 222/75; 222/530

[58] Field of Search ..... 141/392, 346, 192–229, 141/98, 342, 379; 222/74, 75, 530

[56] References Cited

U.S. PATENT DOCUMENTS 2,405,264 8/1946 Marvel ..... 222/74

*Primary Examiner*—Houston S. Bell, Jr.

[57] ABSTRACT

In a bracket for use in conjunction with a fuel dispensing nozzle, said bracket mounting to the nozzle at the location of the joint between the nozzle and its spout, the upper portion of said bracket extending upwardly and outwardly and formed into a hook arrangement, for securing through the nozzle holster that supports the same during nonusage, while the lower portion of the bracket extends downwardly and is integrally bent for connection with the nozzle, thereby assuring a guide that automatically requires shut off of the fuel pump when the nozzle is inserted into its holster as during nonuse.

5 Claims, 6 Drawing Figures

HOOK AND SHUT-OFF BRACKET FOR AUTOMATIC FUEL NOZZLE

BACKGROUND OF THE INVENTION

This invention relates generally to a fuel dispensing nozzle, but more specifically pertains to a unique bracket that rigidly secures with the nozzle and assures its convenient retention within its holster during nonusage, while simultaneously automatically shutting off the fuel pump after dispensing of fuel as when the nozzle is inserted into its supporting holster.

A variety of fuel pump nozzles are available in the art, and as is well known, are for use in conjunction with a fuel pump, for dispensing gasoline, diesel fuel, and related type of high octane fuels. And, most of these nozzles incorporate various means for assuring their mounting within the pump, as during nonusage, but generally such nozzles simply insert their spout into the pump, while the lower portion of the handle of the nozzle rest upon a clip that assures its retention proximate the pump after application. But, it is in those instances where the nozzle is used in conjunction with what is generally identified as a consumer use or farm type pump, particularly of the type which finds usage around the farm, or at other locations, where the consumer may have the pump located upon his own premises, that means have generally not been provided for assuring that the nozzle may be conveniently and stably supported by the pump after usage, which normally has resulted in haphazard usage of the nozzle, uncertainty in the securement of the nozzle to the pump after usage, all of which can and have caused damage to the nozzle due to such desultory usage.

In certain instances, in the prior art, a form of holster means has been applied to the side of the pump, or in proximity therewith, for use in holding the nozzle after its usage in dispensing a particular quantity of fuel, and while the holster has generally worked effectively for supporting the nozzle during nonusage, certain of the problems that have prevailed with the prior art in supporting a fuel nozzle after usage yet prevails, and for this reason, the current invention has been made adaptable for insertion onto the standard nozzle, and assures the accomplishment of its two-fold purposes, the first one being to provide for a hooking of the nozzle onto the holster when inserted therein, which hooking action prevents the nozzle from coming loose from its supporting holster after usage, and after its installation therein, while secondly, a shaped bracket means is formed onto the nozzle and assures that the pump must have been shut off for the nozzle to become conveniently inserted for storage within the holster upon completion of fuel delivery.

It is, therefore, the principal object of this invention to provide a bracket that conveniently mounts stably upon the nozzle, and particularly within proximity of its spout, for a fuel pump, and which bracket functions to assure the proper storage of the nozzle during nonusage.

Another object of this invention is to provide a bracket for use in conjunction with a pump nozzle and which conveniently cooperates with its supporting holster to insure its retention therewith after usage.

Another object of this invention is to provide a bracket for use in conjunction with a nozzle, being rigidly fastened thereto, and which is shape formed into a configuration at its lower segment to assure its cooperation with the shut-off latch of the pump, so that the pump latch must be pivoted to its closed position before the nozzle can be inserted into its holster at the conclusion of the pumping of some fuel.

Another object of this invention is to provide a bracket that can conveniently be added onto existing nozzles for fuel pumps, particularly for the consumer oriented or farm type of nozzle, so as to adapt them for more effective usage and particularly for preservation of the nozzle as when not in use.

Still another object of this invention is to provide a bracket for a nozzle that may be conveniently stamped from an integral piece of metal during one or a few of multiple stamping operations during its fabrication.

Yet another object of this invention is to provide a bracket that integrally includes reinforcement means that assures it stability during usage.

These and other objects will become more apparent to those skilled in the art upon reviewing the summary of this invention, and upon undertaking a study of its preferred embodiment in view of the drawing.

SUMMARY OF THE INVENTION

This invention contemplates the formation of a bracket for addition to the nozzle of a gasoline or other fuel pump, with the bracket having the dual-purposes as previously depicted earlier in this specification. The bracket is designed for mounting onto the spout portion of the nozzle, and therefore is arranged slightly forwardly of the spout lock-nut, and for that matter, the entire body portion of the nozzle. In this particular location, the bracket can be conveniently bent to extend upwardly of the nozzle, and is formed into the shape of a hook, or the like, that is effectively disposed for ccoperating with the nozzle holder, or its holster, thereby providing means for assuring the retention of the nozzle with its supporting structure and to prevent its accidental loosening therefrom as when it may be routinely or roughly handled. In addition, the lower portion of the bracket is conveniently bent to provide yet two additional purposes in its function, the first one being to form a boss or angulated portion that encounters the off-on latch for the pump, in a manner that the nozzle will be restrained from inserting further into its holding holster, unless the latch has been pivoted to its off position. Thus through the usage of this bracket, the pump owner will be assured automatically that it will be shut-off when the nozzle is inserted into its supporting holster. In addition, the lower end of the bracket is further bent into the configuration of the tab, and is designed for having a fastener, such as a screw, inserted therethrough, provided for its fastenings to the frontal portion of the hand guard for the said nozzle. Thus, stability at least at two locations are assured for the attachment of the bracket to the nozzle, the first one being at the location where an aperture through the central base portion of the bracket allows it to insert upon the nozzle spout, while the second location for stability is at that point where the fastener secures the lower end of the bracket to the said nozzle hand guard.

DESCRIPTION OF THE PREFERRED EMBODIMENT

Figure 1:
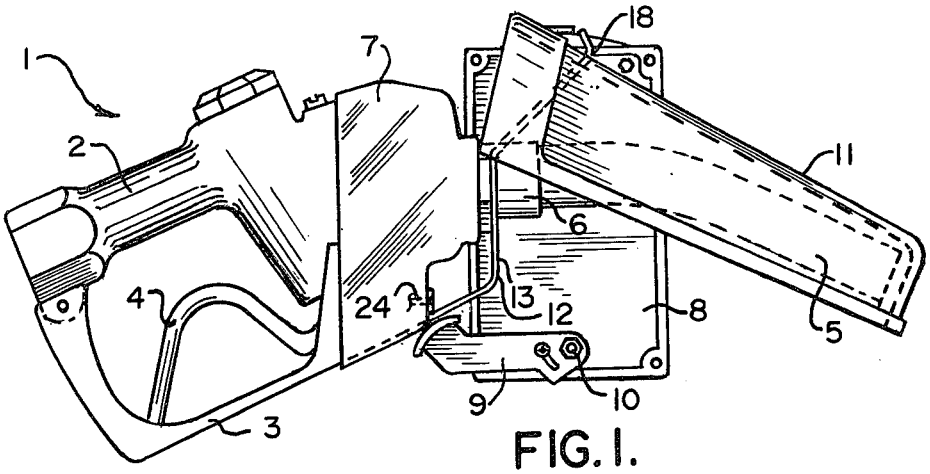
FIG. 1 provides a side view of a nozzle having the bracket of this invention secured thereon and both shown being inserted supportedly within its holster for temporary storage.

In referring to the drawings, in a particular FIG. 1, there is shown the nozzle 1 of this invention which normally incorporates a body portion 2, having a connected hand guard 3 secured therewith, and which protects the dispensing lever 4 normally included in the structure of a fuel dispensing nozzle. Extending forwardly from the front end of the body portion 2 of the nozzle is the pour spout 5 and which is rigidly adhered to the front of the nozzle through the agency of a lock-nut 6. As can be further seen, there is usually some form of a polymer type of fabricated guard 7 that protects the front of the nozzle during its usage.

The means for normally supporting the nozzle, as during nonuse, is also shown, and this comprises a plate like member 8 that secures onto the pump, or some other stationary surface, and which includes an off-on latch 9 that pivotally connects, as at 10, for rotation between its pumping disposition, when it is normally disposed vertically (not shown), and then pivoted downwardly, into the horizontal position as shown when the pump is shut off. In this position, as shown in FIG. 1, the nozzle, and more particularly its hand guard 3, will be in contiguous relationship with the lever 9, but since the hand guard usually terminates at this frontal location, there is never any assurance that the off-on lever 9 will be shut-off, when the nozzle is inserted into its holster, as shown at 11. This holster is also rigidly secured to the plate 8, at its upper region, as shown.

Figure 2:
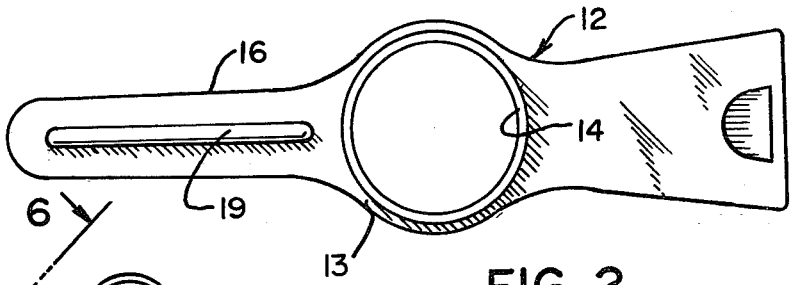
FIG. 2 provides a front view of the nozzle bracket of this invention.
Figure 3:
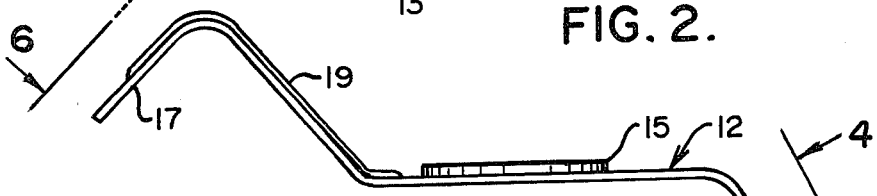
FIG. 3 provides a side view of the bracket of this invention.
Figure 4:
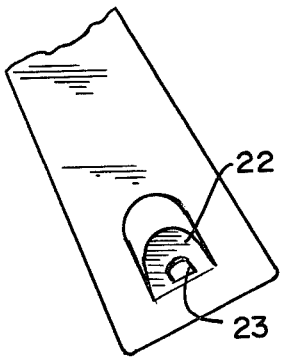
FIG. 4 provides a partial view of the lower end of the bracket of this invention, taken along the line 4—4 of FIG. 3.
Figure 5:
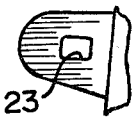
FIG. 5 provides a partial view of the fastening tab located at the lower region of the bracket of this invention, taken along the line 5—5 of FIG. 3.
Figure 6:
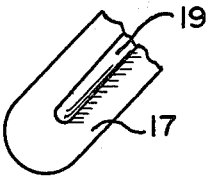
FIG. 6 furnishes a view of the upper end of the bracket, at its integral hook portion, taken along the line 6—6 of FIG. 3.

The bracket of this invention is more accurately depicted at 12, and it can be more fully seen also in FIGS. 2 and 3. As shown, the bracket secures rigidly onto the body portion 2 of the nozzle, at its frontal location, and is secured into position by means of the lock-nut 6 that rigidly secures the nozzle spout 5 to said body portion 2.

The bracket 12 includes a central base portion 13, and this portion includes an aperture as at 14, provided therethrough, with the aperture having surrounding it an upturned edge 15 so as to assure the rigidity of the bracket at least at this location.

Extending upwardly from the central base portion 13 is an upper extending portion 16, which is bent slightly forwardly, and then at its upper region, as at 17, is bent rearwardly forming a hook-like portion that is conveniently disposed for inserting through a slot, as at 18, that is formed through the upper proximate surface of the holster 11 of the nozzle support. As can be seen, this upper extending portion for the bracket is reinforced through the locating of a rib 19, which can be formed during the inherent stamping operation that forms the bracket normally from a single or multiple stamping operation, but said rib is conveniently located along those various bends formed in this upper extending portion for the bracket, and herein provides the sufficient rigidity needed to assure the permanently formed configuration for the bracket during its stamped formation.

The lower extending portion of the bracket, as at 20, is formed through a bend, as at 21, with said portion 20 extending downwardly and rearwardly with respect to the nozzle and is formed having an integral tab 22, which includes an aperture 23 provided therethrough, so that a fastener, as at 24, may be arranged therethrough for rigidly adhering the bracket with the lower front of the body portion 2 of the nozzle, at the location of the front at its connecting hand guard 3. The lower part of the central base portion 13 of the bracket does extend sufficiently downwardly, and is bent at a location rearwardly into alignment to form the lower extending portion 20, and the reason for this type of bend is to provide a means for obstructingly encountering the off-on lever 9 of the pump, particularly during that instance where the lever may remain on, in its vertical location, so that the nozzle will be prohibited from insertion within its holster, thereby instructing the service man to turn off the pump first, by pivoting the lever 9 rearwardly, as shown in FIG. 1, so that the lower part of the bracket will conveniently clear said lever and then be slid into its holster 11, thereby allowing its hook portion 17 to insert through the holster aperture 18 for attaining nozzle storage.

As can be seen, when the off-on lever is pivoted to its off position, as shown in FIG. 1, the lower part of the bracket 20 will then rest upon the upper curved part of the lever 9, holding it in its off position, which thereby prevents any inadvertent dispensing of gasoline, should someone accidentally grasp the nozzle, or more specifically its dispensing lever 4, before timely usage is required.

Various modifications to the bracket may occur to those skilled in the art upon reviewing the subject matter of this invention. The basic description of the preferred embodiment of this invention is set forth primarily for illustrative purposes only, and are not intended to limit the scope of protection of any patent to issue upon the same. Hence, any variations or modification to this development within the spirit of this invention are intended to be encompassed by the scope of any claims to patent protection issuing upon the same.

Having thus described the invention what is claimed and desired to be secured by Letters Patent is:

1. A bracket for use in conjunction with an automatic fuel nozzle and its supporting holster and for assuring that the associated pump is shut off as the nozzle is hooked into the holster as during nonusage, comprising, said bracket having a central base portion for securing onto the spout portion of the nozzle, said bracket including an aperture provided through its central base portion, with the spout of said nozzle being inserted through said aperture, said bracket having an integral upper extending portion for use in supportingly hooking onto the holster during that period of nonuse, said bracket having an integral lower portion that forms a guide for assuring automatically that the pump is shut-off as when the nozzle is inserted into its supporting holster, means provided upon the lower end of said bracket for rigidly fastening the same to the nozzle, whereby said bracket is stably secured at two locations in its attachment to the fuel nozzle.

2. The invention of claim 1 and including an upturned edge surrounding the formed aperture provided within the central base portion of the bracket for reinforcing said bracket at this location.

3. The invention of claim 1 and including a reinforcing rib formed integrally at least along part of the length of the upper extending portion of the said bracket for reinforcing said bracket at the location of its formed hooking portion.

4. The invention of claim 1 and including the means provided upon the lower end of said bracket for rigidly fastening to the nozzle comprising an integral tab formed extending inwardly of said bracket, and said tab having an aperture provided therethrough for accommodating a fastener for securing said tab and its associated bracket to the nozzle.

5. The invention of claim 1 wherein said integral lower portion of the bracket extending downwardly from the nozzle spout, and being bent inwardly towards the lower part of said nozzle, said integral bend providing the guide that assures that the pump is shut off when the nozzle is inserted into its supporting holster upon completion of a fuel dispensing operation.

* * * * *

UNITED STATES PATENT AND TRADEMARK OFFICE

CERTIFICATE OF CORRECTION

PATENT NO. : 4,331,190
DATED : May 25, 1982
INVENTOR(S) : Sutcliffe, et al

It is certified that error appears in the above—identified patent and that said Letters Patent is hereby corrected as shown below:

Page 1, at number 73, the assignee should be ---Husky Corporation---, and "Ausley Corporation" should be eliminated.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*